US005193966A

United States Patent [19]

Jung

[11] Patent Number: 5,193,966

[45] Date of Patent: Mar. 16, 1993

[54] FEEDING DEVICE FOR BOLT BLANKS IN MACHINES FOR PROFILING BY MEANS OF ROLLING JAWS

[75] Inventor: Clemens Jung, Hilchenbach, Fed. Rep. of Germany

[73] Assignee: E. W. Menn GmbH & Co. Maschinenfabrik, Hilchenbach, Fed. Rep. of Germany

[21] Appl. No.: 695,872

[22] Filed: May 6, 1991

[30] Foreign Application Priority Data

May 8, 1990 [DE] Fed. Rep. of Germany ..... 4014671

[51] Int. Cl.[5] ..... B23Q 7/08

[52] U.S. Cl. ..... 414/224; 221/242; 414/745.2; 414/745.7; 414/746.4; 414/917

[58] Field of Search ..... 414/224, 745.2, 745.7, 414/746.3, 746.4, 745.1, 900, 917; 198/836.3; 193/2 C, 38; 221/242, 304; 83/449; 72/428; 226/196, 199

[56] References Cited

U.S. PATENT DOCUMENTS

| | | | |
|---|---|---|---|
| 1,615,040 | 1/1927 | Risser | 221/242 |
| 3,123,251 | 3/1964 | Schneider, Jr. | 221/242 |
| 3,974,953 | 8/1976 | Klose | 226/199 X |
| 4,684,309 | 8/1987 | Horn et al. | 414/224 |

FOREIGN PATENT DOCUMENTS

| | | |
|---|---|---|
| 1272823 | 7/1968 | Fed. Rep. of Germany . |
| 2151081 | 1/1975 | Fed. Rep. of Germany . |

*Primary Examiner*—Michael S. Huppert
*Assistant Examiner*—William M. Hienz
*Attorney, Agent, or Firm*—Young & Thompson

[57] ABSTRACT

The feeding device (1) comprises two sliding rails (2, 3) arranged in parallel to each other and obliquely to the horizontal. The gap (5) between these rails can be adjusted to the diameter of the bolt blanks to be profiled. In order to be able to perform this adjustment of the gap (5) faster and more accurately, the sliding rails (2, 3) form a parallelogram-type linkage with traverses (10) located above these rails and obliquely to their longitudinal extension. The traverses (10) are attached to bars (9) rotatable in clamping sleeves (6, 7) and mounted so that they can be fixed in position. The clamping sleeves (7) on the movable sliding rail (3) are located, in the conveying direction of the feeding device (1), in front of those (6) on the fixed sliding rail (2), so that the width of the gap (5) is adjustable by pivoting the traverses (10). The device is utilized in machines for rolling thread or other peripheral profiling operations.

2 Claims, 3 Drawing Sheets

FEEDING DEVICE FOR BOLT BLANKS IN MACHINES FOR PROFILING BY MEANS OF ROLLING JAWS

FIELD OF THE INVENTION

The invention relates to a feeding device for bolt blanks in machines for profiling by means of rolling jaws, with two sliding rails arranged in parallel to each other, adjustable to the diameter of the bolt blanks, and extending obliquely to the horizontal, having rail end sections mounted in exchangeable fashion, a cyclically controlled loading slide for inserting the individual bolt blanks in the rolling jaws being arranged in front of these end sections at an acute angle with respect to the sliding rails.

BACKGROUND OF THE INVENTION

The adjustment of the sliding rails to other bolt diameters in conventional devices of the aforementioned type is time-consuming and requires special skill from the machine setter. The exchanging of the sliding rail end sections, which are wear-prone parts, is likewise cumbersome since these are threaded in place by means of several screws.

A feeding device for rod-shaped workpieces, especially welding electrodes, has been known from DE-AS 1,272,823. This apparatus comprises a vertical guide chute below a funnel-shaped storage container, this chute being defined by walls or rails, the mutual spacing of which is adjustable in adaptation to the diameter of the rods (welding electrodes) by way of oblique fishplates forming a parallelogram. The walls of the guide chute are swung to and fro by way of an eccentric and a bar for separating the rods and depositing them on a conveyor belt.

In a feeding device for eyelet rings and the like in riveting machines known from DE-AS 2,151,081, a sliding rail gap is adjusted by way of an adjusting spindle and oblique slots in order to adapt the gap to the diameter of the workpieces.

SUMMARY OF THE INVENTION

The invention is based on the object of simplifying, in a profiling machine, especially a thread rolling machine, the adjustment of the obliquely arranged sliding rails for the bolt blanks and the exchange of the end sections thereof.

This object has been attained, starting with the device of the type discussed above, in accordance with the invention by the features recited in the claims.

On account of the provision of the traverses arranged obliquely to the sliding rails and above the latter, which traverses are connected to bars seated in clamping sleeves, it is possible to perform an always parallel adjustment of the sliding rails for adapting the gap between them to the diameter of the bolt blanks since the traverses form a parallelo-gram-type linkage with the sliding rails. The adjusting of the sliding rails can take place faster and more accurately. Besides, the novel arrangement eliminates the need for any cross connections or traverses below the sliding rails so that the conveying of even very long bolt blanks is not impeded. Exchanging of the sliding rail end pieces can be conducted much faster with the clamping claws than heretofore possible.

BRIEF DESCRIPTION OF THE DRAWINGS

The drawing illustrates ne embodiment of the invention in a simplified way, i.e. omitting conventional details not pertaining to the invention. In the drawing.

DETAILED DESCRIPTION OF THE INVENTION

Figure 1A:
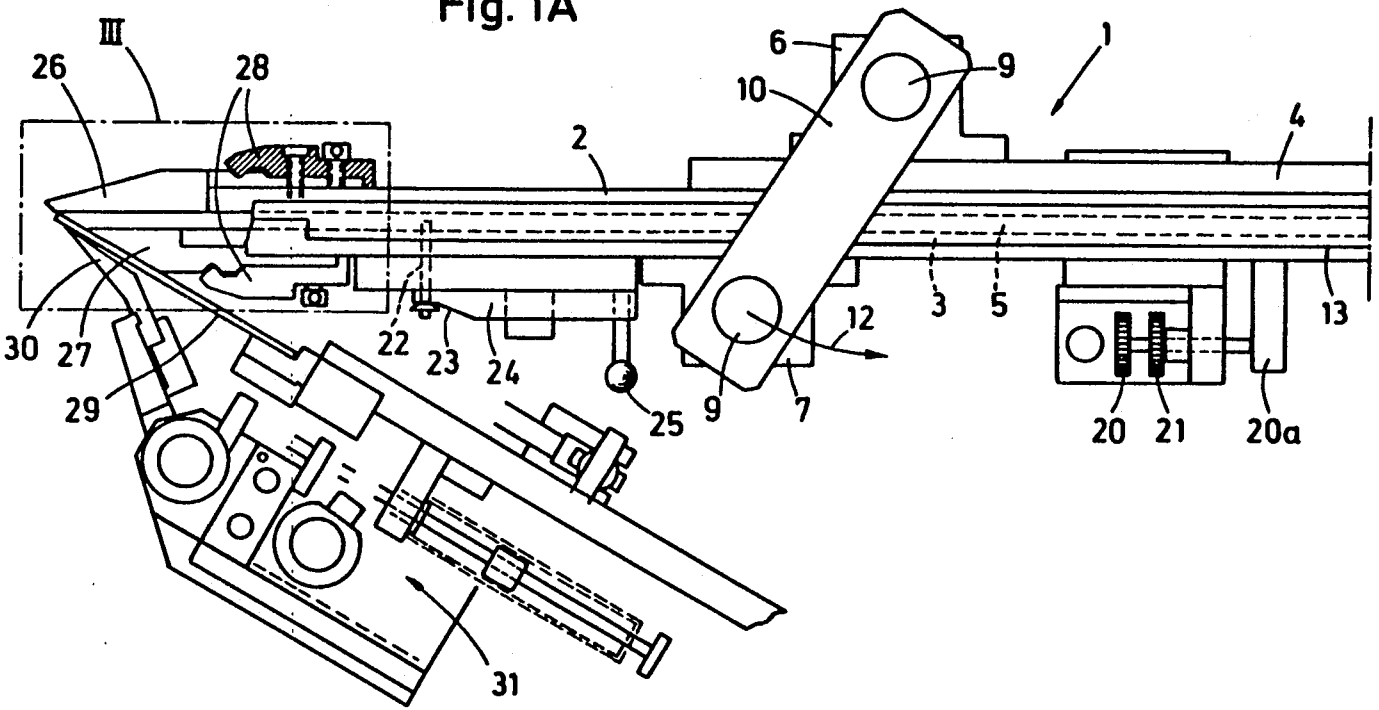
FIGS. 1A and 1B, with FIG. 1B being combinable with FIG. 1A on the right-hand side, show a top view of the device.

The illustrated device 1 for feeding bolt blanks (not shown) to the rolling jaws of a bolt profiling machine, e.g. a thread rolling machine, consists essentially of two sliding rails 2 and 3, one of these rails 2 being fixedly mounted to the machine frame 4 while the other sliding rail 3 is adjustable for setting a gap 5 between the sliding rails 2, 3 in correspondence with the diameter of the bolts to be profiled, for example screw blanks.

Figure 1B:
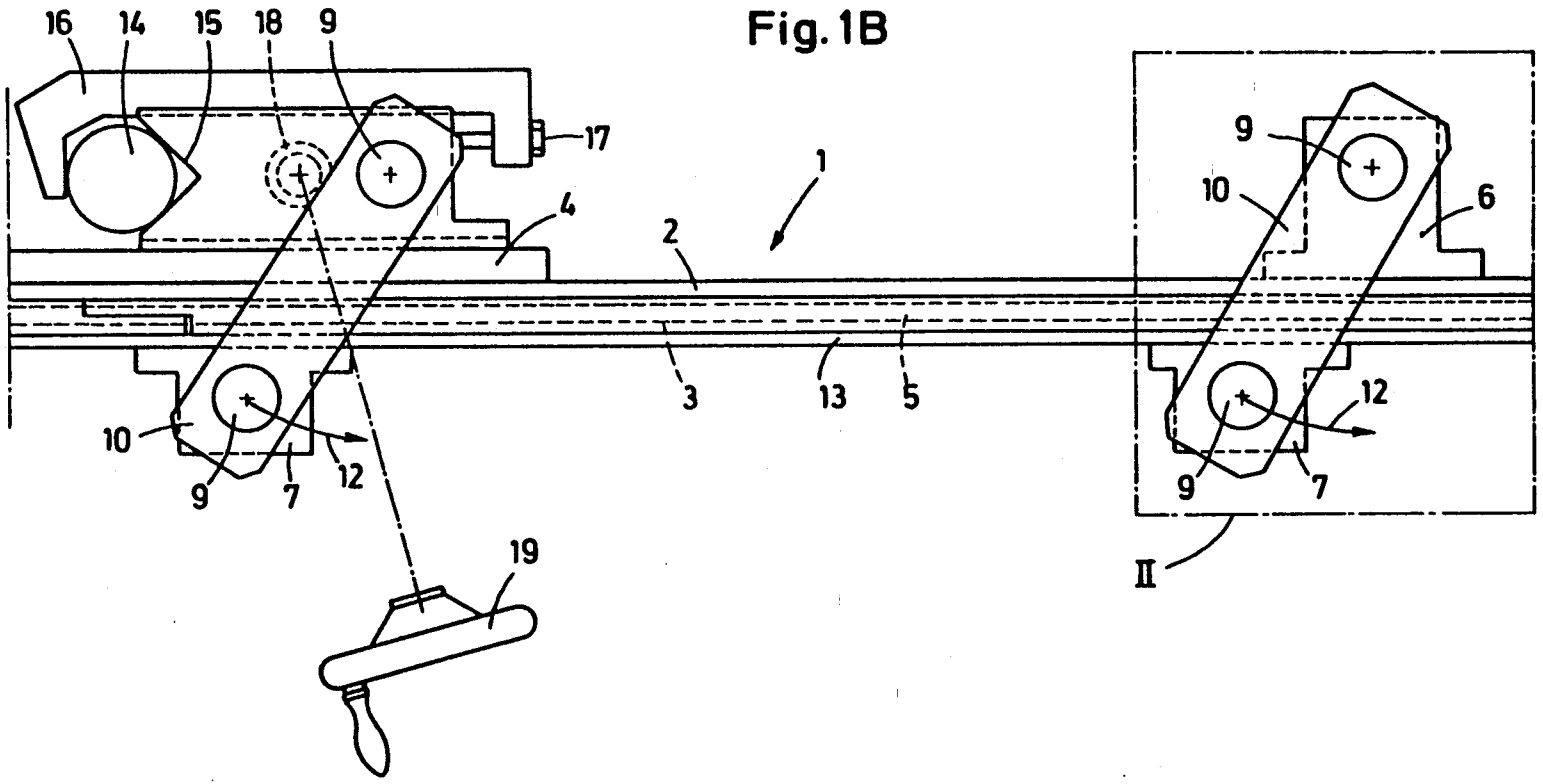
Figure 2:
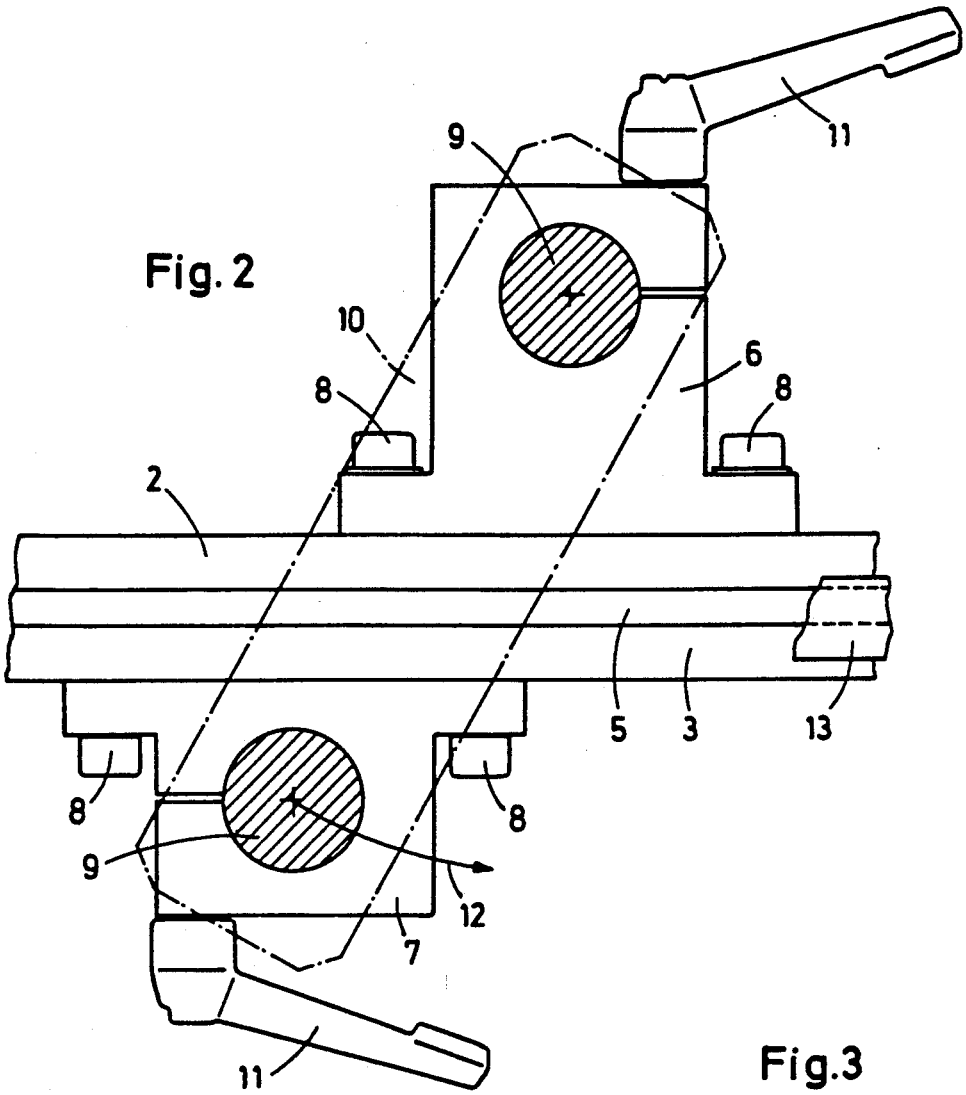
FIG. 2 shows, on a somewhat enlarged scale, a detail II of FIG. 1B.

For this purpose, several clamping sleeves 6 and 7, respectively, are mounted, distributed over the length of the sliding rails 2, 3, by means of screws 8 (see also FIG. 2). The clamping sleeves 7 attached to the movable sliding rail 3 are each seated, in the conveying direction of the bolt blanks (toward the left in the figures), in front of the clamping sleeves 6 attached to the fixed sliding rail 2. Bars 9 are disposed in the clamping sleeves 6, 7, these bars being connected with each other by way of traverses 10. The arrangement is such that the traverses 10 form a parallelogram-type linkage with the sliding rails 2, 3. After slightly loosening the clamping sleeves 6, 7 at hand levers 11 (FIG. 2), the movable sliding rail 3 can be adjusted by simultaneous pivoting of the traverses 10 about the bars 9 in the clamping sleeves 6 of the fixed sliding rail 2. By pivoting in the direction of the arrows 12 (FIGS. 1A, 1B and 2), the gap 5 is enlarged and, in the reverse direction, reduced. In order to determine or to control the correct width of the gap 5, it is merely necessary to insert a bolt blank at an arbitrary location in the gap 5. The adjusting device ensures that the gap width is the same over the entire length of the feeding device 1.

Figure 3:
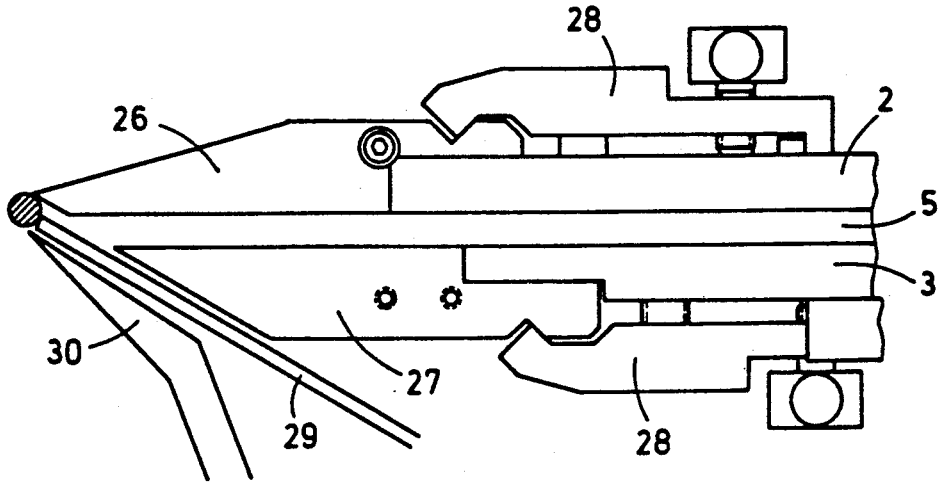
FIG. 3 shows an enlarged detail III of FIG. 1A.

Above the sliding rails 2, 3 and the gap 5, a vertically adjustable cover strip 13 is provided in the usual way; this strip is shown in FIGS. 1A and 2 partially broken away and is not illustrated in FIG. 3.

The entire feeding device 1 is vertically adjustable on a guide column 14 and can be fixed in position in a V-block 15 by means of a clamping member 16 with screws 17. A vertical adjustment is necessary, for example, in case, on the one hand, screws with a shank, for example, and, on the other hand, those without a shank are to be provided with a rolled thread. The vertical adjustment of the feeding device 1 takes place via a spindle 18 operable by way of bevel gears (not visible) by means of a handwheel 19 (see FIG. 1B).

FIG. 1A shows a stop 20*a*, adjustable by means of a screw 20 and to be secured with a counter nut 21, as an auxiliary means during adjustment of the gap 5 wherein the bolt blanks are fed to the rolling jaws (not shown) in the feeding device 1 which latter is arranged in an inclined plane.

A spring-loaded locking pin 22 is located in the usual way on the movable sliding rail 3, this pin being in the locking position according to FIG. 1A, projecting into the gap 5 in order to prevent feeding of further bolt blanks in case some work is carried out at the forward bottom end of the feeding device 1 or in case a collecting bin for the finished profiled bolts, e.g. screws, is changed, or in case, for other reasons, the further tooling of bolt blanks with the machine in operation is to be stopped. The locking pin 22 can be moved out of the gap 5 by way of an inclined surface 23 of a slide 24. A handle 25 is provided at the slide 24 for this purpose.

Rail end sections 26 and 27, which, being wear-prone parts, must be exchanged from time to time, can be readily and quickly released and mounted since they are held with clamping claws 28 (see, in this connection, especially FIG. 3). During operation of the machine, an insert slide 29 moves in front of the rail end sections 26, 27; this slide is cyclically controlled and feeds the bolt blanks to the rolling jaws at the correct instant. The bolt blanks, one of which is indicated in FIG. 3 on the left-hand side in a sectional view, are separated by a likewise cyclically controlled separating tongue 30. The control means for the separating tongue 30 is generally indicated at 31 in FIG. 1A.

I claim:

1. Feeding device for bolt blanks in machines for profiling by means of rolling jaws, comprising: two sliding rails arranged in parallel to each other, one of said rails being fixedly mounted to a machine frame, while the other is movably adjustable for setting a gap between said sliding rails corresponding to the diameter of the bolt blanks, said movable sliding rail including an adjustable stop means for limiting the width of the gap, said sliding rails extending obliquely to the horizontal, and having rail end sections detachably mounted thereon, said sliding rails being vertically adjustable on a guide column by a spindle operable via bevel gears by means of a hand wheel, a cyclically controlled loading slide for inserting the individual bolt blanks in the rolling jaws being arranged in front of said end sections at an acute angle with respect to the sliding rails, a plurality of clamping sleeves attached to said one fixed sliding rail and to said other movable sliding rail, respectively, said clamping sleeves being distributed at mutual spacings over the length of the sliding rails and having rotatably adjustable bars seated therein, said bars being connected to upper traverses extending above the sliding rails and obliquely thereto, said clamping sleeves attached to the movable sliding rail being disposed in front of the clamping sleeves attached to the fixed sliding rail in such a manner that the traverses and the bars form, with the sliding rails, parallelogram-type linkages for adjusting the width of the gap between the sliding rails.

2. Device according to claim 1, wherein the sliding rail end sections are detachably mounted to the sliding rails by means of clamping claws.

* * * * *